US005997113A

United States Patent [19]

Benson

[11] Patent Number: 5,997,113

[45] Date of Patent: Dec. 7, 1999

[54] HAND FOLDABLE AND PORTABLE FURNITURE

[76] Inventor: Cleon E. Benson, 1901 Pine Crest Dr., Corona, Calif. 91720

[21] Appl. No.: 09/086,893

[22] Filed: May 29, 1998

[51] Int. Cl.[6] ..... A47B 19/08

[52] U.S. Cl. ..... 312/195; 312/262; 108/115; 108/50.01; 16/389; 16/392

[58] Field of Search ..... 211/149, 135; 16/389, 392; 108/50.01, 115, 193, 162, 159, 157.15, 157.17, 50.02; 312/258, 259, 262, 140.2, 140.3, 140.1, 195, 208.1

[56] References Cited

U.S. PATENT DOCUMENTS 242,355 5/1881 Nicholas ..... 312/262 X
2,764,462 9/1956 McDonald ..... 312/140.2
2,808,305 10/1957 Jackson ..... 312/140.2
5,769,514 6/1998 Brown et al. ..... 312/195

*Primary Examiner*—Janet M. Wilkens
*Attorney, Agent, or Firm*—Robert R. Meads

[57] ABSTRACT

A hand foldable and portable article of furniture comprising planar back and right and left side members hinged at edge surfaces thereof such that the right and left side members swing between a folded position with the side members on a back of the back member and a unfolded position in which the side members are substantially perpendicular to the back member and upper edges of the back and side members are interlocked in mating grooves in a planar top member, one of the back and side members being transversely bendable at its upper edge to spring lock into its mating groove to tightly interlock the article of furniture in its unfolded position.

13 Claims, 12 Drawing Sheets

HAND FOLDABLE AND PORTABLE FURNITURE

FIELD OF INVENTION

The present invention relates to improvements in furniture and more particularly to improved hand foldable and portable articles of furniture including desks, bars, counters and bookcases.

BACKGROUND

Over the years there has been a continuing need for foldable articles of furniture which are readily transportable from one location to another for reassembly in a rapid and efficient manner. Prior patents directed to such articles of furniture include U.S. Pat. Nos. 168,879; 242,355; 835,902; 1,559,878; 2,764,462; 2,932,343; 4,082,389; 4,236,460; and 4,579,401.

Specifically, the '879 patent shows a foldable wardrobe comprising side members F, F hinged to a pair of back members A, A. A pair of shelves C and C slide in grooves in the inside of the side pieces F, F and are secured in place by hooks or other connectors. A top member E also has grooves in an underside which receive tongues extending from the upper edges of back and side members. In practice, the two piece back and the hinge connection therefore provides a relatively unstable back for the wardrobe. Further, the side members are not hinged to fold outward over the back of the wardrobe to form a compact package. Finally the structural integrity of the wardrobe depends upon the tongue and groove connections between the top and sides and the connector attachment for the shelves to the sides of the wardrobe.

The '355 patent also discloses a folding wardrobe having a back member, hinged side members, shelves for sliding in open-ended grooves and a pair of pins that cooperate with holes in a top (not shown) for securing the wardrobe together. The hinges disclosed in the '355 patent and the groove A' at the point where the side members engage the back members preclude the side members from swinging outwardly to a folded position on a back surface of the back of the wardrobe to form a compact package for transport from one location to another. Further, the entire structural rigidity depends upon the top which is pinned to the side members.

The '902 patent also discloses a folding wardrobe having a rigid back b, a pair of side members c hinged to the back and a top d also hinged to the back. The hinge connection for the sides to the back only allow the sides to fold forward over the back while the rings c4 and cleats c5 prevent the folding of the sides and back into a compact package.

The '878 patent discloses a collapsible camp cupboard having a back 1 and side abutments 2 and 3 rigidly secured to the back 1. The abutments are a little thicker than shelf boards 6, 7, 8, 9 and 10 which loosely fit between the abutments in front of the back and are secured pivotally in place and by virtue of binding strips 11 and 12 swing freely from horizontal positions downwardly to vertical positions within the cupboard. Side boards 20 and 25 are connected to the abutments 2 and 3 by hinges and are adapted to swing inwardly to cover the folded shelves. Thus, while the cupboard is collapsible, it is not collapsible to a condition where the side members swing outwardly over the back to form a highly compact structure for easy transport from one location to another.

The '462 patent discloses a portable, collapsible bar with side members 7 and a top 9 hinged to a back 6. A top 9 rests on the upward edges of the back and side members while dowels 11 project downwardly at the underside of the top into openings 12 in a metal plate 13 recessed in the upper edge of each of the side members to lock the top to the side members with the bar in its erected position. The hinge structure for the back and side and top members does not produce a highly compact package upon folding of the bar to a collapsed position. Further, the support structure for the bar and the method of assembly and disassembly of the bar are complicated.

The '343 patent discloses a collapsible portable stand-up table. The table includes a vertically extending back member 24 having side members 18 and 20 secured by hinges to an inner face thereof. A front member 22 is hinged to an outside of the side member 20. A removable top tray 10 fits on top of the back, front and side members when they are assembled in a rectangular pattern. The hinge connections for the table are such that the side 19 folds inward over a front or inner side of back member 24 while the side member 20 folds inward over the side 18 and the back 24 with the front 22 folding inward over the side 20. None of the hinges allow the sides to pivot outwardly relative to the back member and over a back thereof to form a highly compact package. Further, the table includes latches for securing the top 12 to the body comprising the back and side members.

The '389 patent discloses a collapsible camp supply unit comprising a multi-shelf cabinet wherein outwardly extending tongues from the shelves fit through slots in the sides, front and back of the cabinet to be secured by clothespins. The front and back of the cabinet consists of hinged sections for folding along a vertical line connection between the sections. The side members are also connecting by hinges to the sections comprising the back member to swing inwardly over the insides of the back member when it is desired to fold the cabinet. As noted, the cabinet does not include hinges which allow the side members to fold outwardly relative to the back to form a compact package for transport and the connection of the various parts is via the clothespins extending through the tongues of the shells beyond the side members. Thus, the cabinet is relative unstable when assembled and does not fold to a highly compact package for transport.

The '460 patent describes a foldable furniture system consisting of four vertical posts supporting side members to a back. The sides are adapted to swing inwardly relative to the back rather than outwardly to lie on the back surface of the back member in a highly compact package.

The '471 patent describes a collapsible cabinet including a base to which side members and a back are hinged for folding inwardly over the base member. Latches are included to hold the side panels latched to the front when the cabinet is erected and to provide structural integrity to the cabinet. Thus, when assembled, the cabinet is somewhat unstable and is not capable of being collapsed to a highly compact package for transport.

Thus, there is a continuing need for hand foldable and portable furniture which is foldable to a highly compact package and which is easily unfolded to a sturdy unit of furniture. The present invention satisfies such needs.

SUMMARY OF INVENTION

To overcome the shortcomings of the prior art, the present invention comprises a hand-foldable article of furniture such as a desk, a counter, a bar or a bookcase which is easily folded into a compact, light weight package for hand transportation from one location to another and which may be easily and quickly assembled into a sturdy and durable article of furniture. More particularly the article of furniture comprises a planar back and right and left side members hinged at edge surfaces thereof such that the right and left side members swing between a folded position with the side members on a back of the back member and an unfolded or set up position in which the side members are substantially perpendicular to the back member. Upper edges of the back and side members are interlocked in mating grooves in a planar top member and one of the back and side members is transversely bendable at its upper edge to adjust and spring lock into its mating groove to tightly interlock the article of furniture in its set up position.

BRIEF DESCRIPTION OF DRAWINGS

In FIG. 4*a* an upper portion of the right side member is transversely bent to fit and spring lock into a mating groove in the top of the desk while in FIG. 4*b* the upper portion of the left side member is transversely bent to fit and spring lock into a mating groove in the top of the desk.

DETAIL DESCRIPTION OF A PREFERRED EMBODIMENTS OF INVENTION

Generally speaking, the present invention comprises a hand-foldable article of furniture which is easily folded into a compact light weight package that can be hand transported from one location to another and which may be easily and quickly assembled into a sturdy, durable and light weight article of furniture. The article of furniture according to the present invention may comprise, for example, a desk, a counter, a bar or a bookcase each of which is illustrated in different figures of the attached drawings.

Each embodiment of the present invention includes certain common unique features which will be described in detail hereinafter. Briefly, these include a unique construction which allows an upper portion of one of the back, right side or left side members to be transversely bendable from the plane thereof such that in fitting into a mating groove in the under surface of a planar top member, the bendable member is in effect being spring loaded to tightly interlock the back, right and left side members within mating grooves of the top member to produce a very sturdy article of furniture in its set up position. Further, each embodiment of the present invention includes a unique hinge construction which allows the right and left side members to be swung between a compact folded position where the right and left side members lie substantially parallel to and on a back surface of the back member and a set up position where the right and left side members swing to a position substantially perpendicular to and forward of a front of the back member. Still further, in the desk embodiment of the present invention, an additional spring loaded interlocking structure is included comprising a shelf having a transversely bendable upwardly extending back member which when bent and effectively spring loaded fits into a mating vertically extending groove in one of the side members to tightly interlock the shelf to the right and left side members thereby enhancing the rigid construction of the desk in its unfolded position. If desired, similar supplemental spring loaded interlocking shelves may be included in the bar, counter and bookcase embodiments of the present invention.

Figure 3:
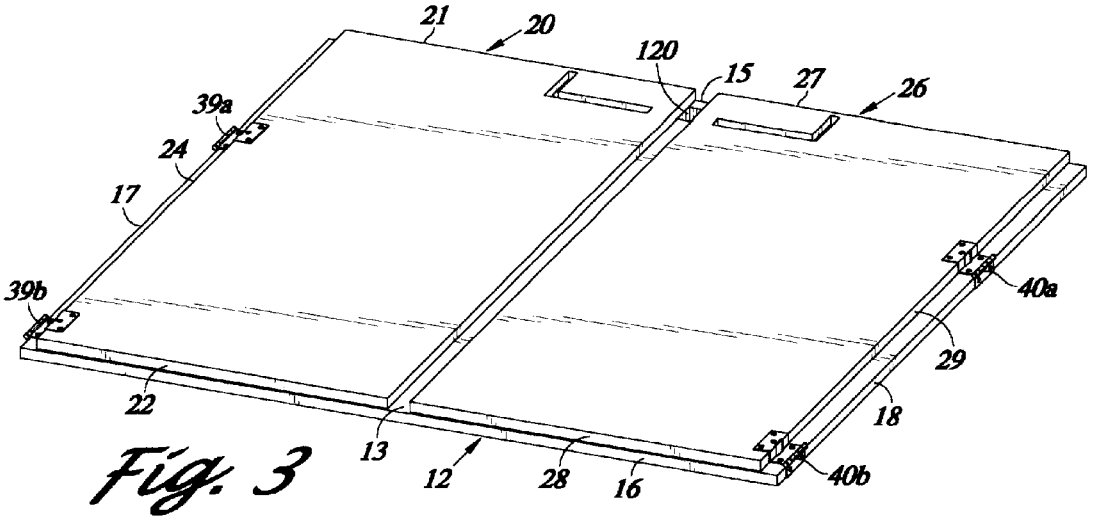
FIG. 3 is a perspective view of the back and sides of the desk of FIG. 1 connected by a hinge system according to the present invention whereby the right and left side members are foldable over the back member to the folded position illustrated in FIG. 3 and moveable to the unfolded or set up position illustrated in FIGS. 1 and 2.
Figure 1:
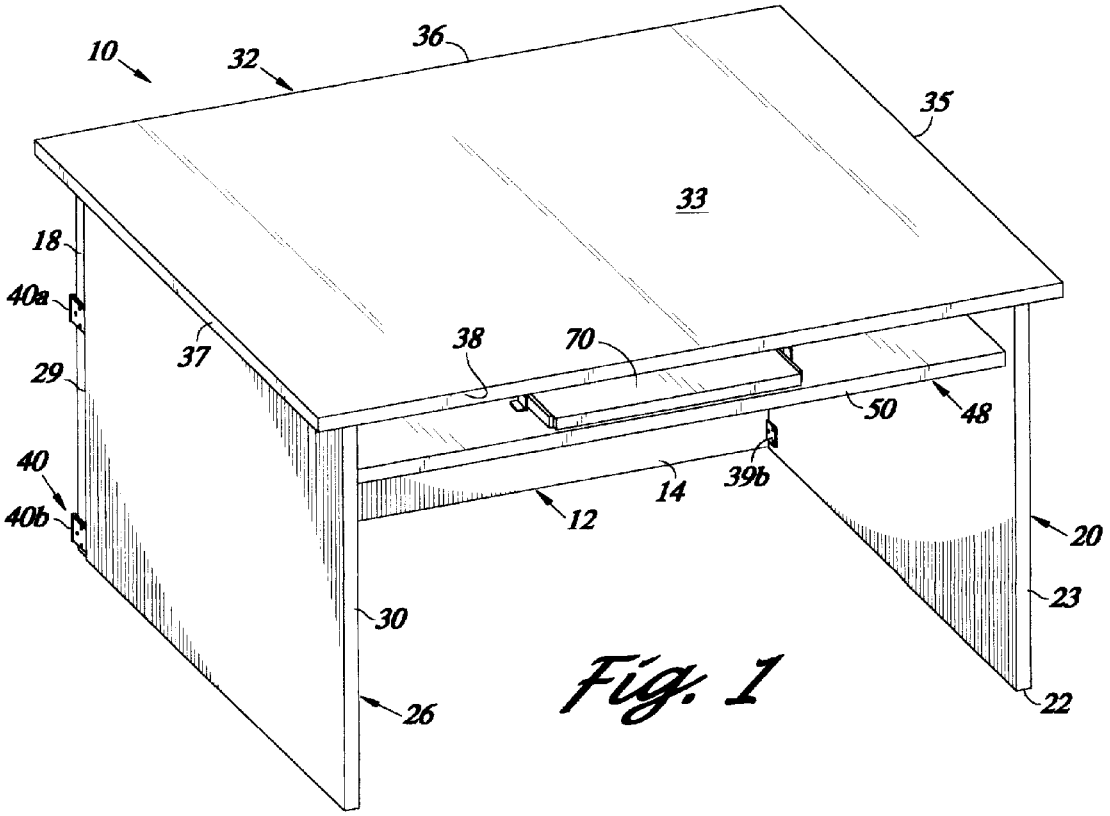
FIG. 1 is a perspective view of a foldable article of furniture comprising a desk constructed in accordance with the present invention.
Figure 2:
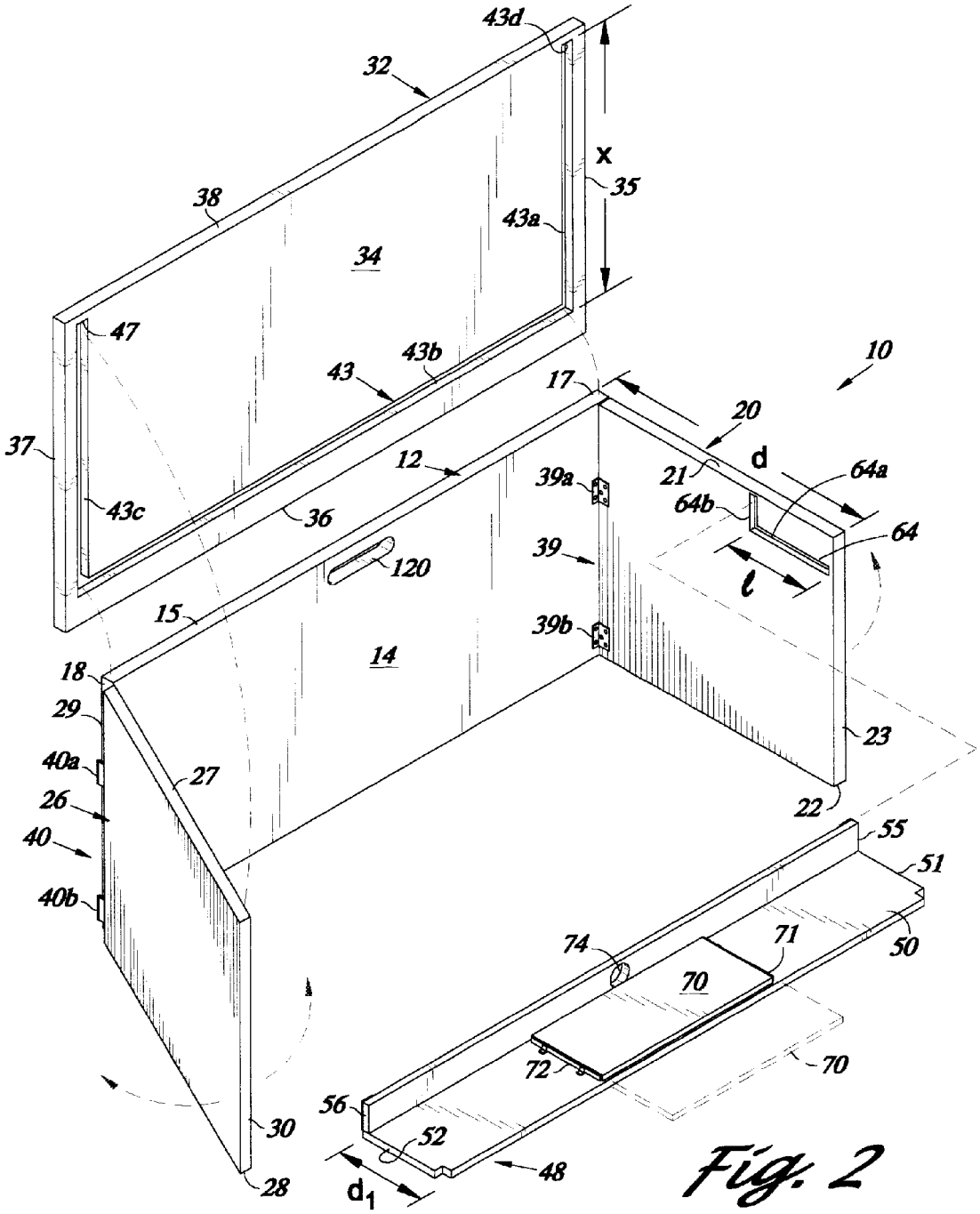
FIG. 2 is an exploded view of the desk of FIG. 1 illustrating the component parts comprising planar back, right and left side members, a planar top and a shelf for interlocking between the right and left side members.

The embodiment of the present invention comprising a desk 10 is illustrated in FIGS. 1, 2 and 3. As shown most clearly in FIG. 2, the desk 10 comprises a planar back member 12, planar right and left side members 20 and 26, and a planar top member 32. The back member 12 includes a back surface 13 and a front surface 14 and top, bottom, right and left edge surfaces 15, 16, 17 and 18 respectively. The planar right side member 20 includes top, bottom, right and left edge surfaces 21, 22, 23 and 24 respectively while the planar left side member 26 includes top, bottom, right and left edge surfaces 27, 28, 29 and 30 respectively. Similarly, the planar top member 32 includes a top surface 33, a bottom surface 34 and right, back, left and front edge surfaces 35, 36, 37 and 38 respectively.

In accordance with the present invention, the right and left side members 20 and 26 are moveable between the set up position of FIGS. 1 and 2 and the compact folded position depicted in FIG. 3. To provide for such movement, each embodiment of the present invention including the desk 10, comprises unique first and second hinge means 39 and 40. In the embodiments of the present invention illustrated in the drawings, the hinge means 39 includes a pair of identical hinges 39*a* and 39*b* and the hinge means 40 includes a pair of identical hinges 40*a* and 40*b*. Each of the hinges is secured at a right or a left edge surface (17 or 18) of the back member 12 and to one of the left and right side members. Further, the hinges 39*b* and 40*b* are located below the hinges 39*a* and 40*a* adjacent to the bottom edge surface 16 of the back member 12. The hinges 39*a* and 40*a*, on the other hand, are spaced vertically above the hinges 39*b* and 40*b* respectively, but are spaced downwardly from the top edge surface 15 of the back member 12. As will be described in greater detail hereinafter, such a location for the hinges 39*a* and 40*a* allows the upper portion of the back member 12 to be bendable transversely from the plane thereof adjacent its top edge surface 16 to fit in a spring loaded manner into a section of a U-shaped slot 43 in the bottom surface 34 of the top member 32 during assembly of the desk in accordance with the present invention. The placement of the hinges 39*a* and 40*a* also allows upper portions of the side members 20 and 26 to be flexed, if necessary, to mate with other sections of the slot 43 during assembly of the desk in accordance with the present invention.

Figure 7:
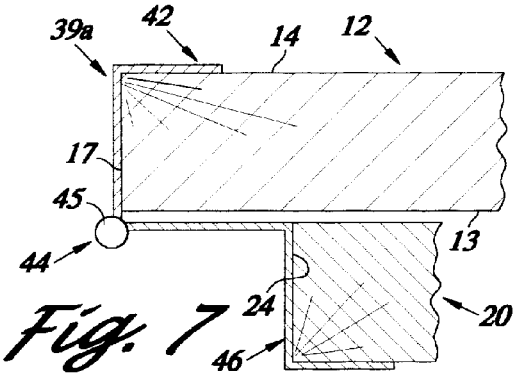
FIG. 7 is a fragmentary sectional top view of the unique hinge structure of the present invention illustrating the back and the right side member in the folded position with the right side member lying substantially parallel to and on a back surface of the back member.
Figure 8:
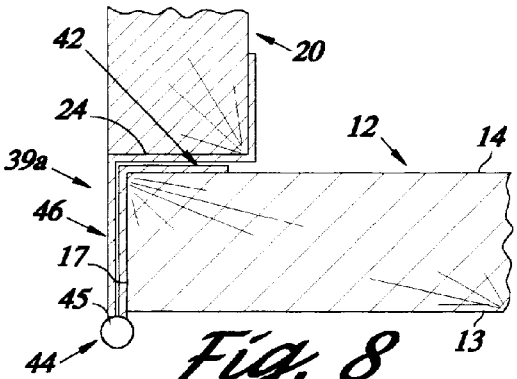
FIG. 8 is a fragmentary sectional top view similar to FIG. 7 illustrating the right side and back members in the unfolded or set up position with the side member substantially perpendicular to the back member.

The identical structure of the hinges 39*a* and 39*b* and 40*a*, 40*b* is depicted in FIGS. 7 and 8 for the hinge 39*a* secured to the back member 12 and right side member 20. As illustrated, the hinge 39*a* includes a L-shaped hinge plate 42 connected to the front facing (or inside) surface 14 of the back member 12 at right edge surface 17 as by screws (not shown) or other suitable connecting means. The hinge plate 42 extends vertically from a conventional pivot 44 including a pivot pin 45 received by vertically spaced loops extending from an end of the hinge plate 42 and similar interleaving loops of a modified L-shaped hinge plate 46 connected as by screws (not shown) to an inside of the right side member 20 at the left edge surface 24. The width of the hinge plate 46 between the pivot 44 and the point where it bends to engage the left edge surface 24 of the right member 20 is slightly greater than the width of the back member 12 as depicted in FIG. 8. This allows the right side member 20 to swing between a folded position as depicted in FIG. 7 where the right side member lies on and is substantially parallel to the back surface 13 of the back member 12, and an unfolded position as depicted in FIG. 8 where the right side member extends vertically and perpendicularly forward of the front surface 14 of the back member 12. In this regard, it is noted that in the unfolded position of FIG. 8 the outside of the right side member 20 is nearly in the vertical plane of the right edge surface 17 of the back member 12.

The structure and connection of the hinge 39*b* to back and right side members 12 and 20 are the same as just described for the hinge 39*a* with the exception of the mounting location for the hinge 39*b* adjacent the bottom edge 16 of the back member 12.

The structure and connection of the hinges 40*a* and 40*b* to the back and left side members 12 and 26 are an image that of the hinge 39*a* depicted in FIGS. 7 and 8 with the exception that the L-shaped hinge plate 42 is connected to the left edge surface 18 of the back member 12 and extends from a vertically extending pivot 44 adjacent the back surface 13 of the back member while the modified L-shaped hinge plate 46 extends from the pivot a distance greater than the width of the back to an inside of the left side member 26 at the right edge surface 29.

Again, the hinge 40*b* is located adjacent the bottom 16 of the back member 12 while the hinge 40*a* is located at a distance spaced from the top edge surface 15 of the back member. Such connection of the hinge means and the spacing of the hinges 39*a* and 40*a* from the top edge surface 15 of the back member 12 allows at least an upper portion of at least one of the back, right or left side members 12, 20 or 26 to be transversely bendable from the plane thereof. This is particularly important in the previously referenced spring loaded interlocking connection for the back, right and left side and top members of the articles of furniture constructed in accordance with the present invention. Such a spring interlocking connection is common to each of the illustrated embodiments of the present invention comprising the desk 10 of FIG. 1, the bar 80 of FIG. 9, the counter 90 of FIG. 12 and the bookcase 100 of FIG. 14 and is depicted for the bar in FIG. 4.

Figure 4:
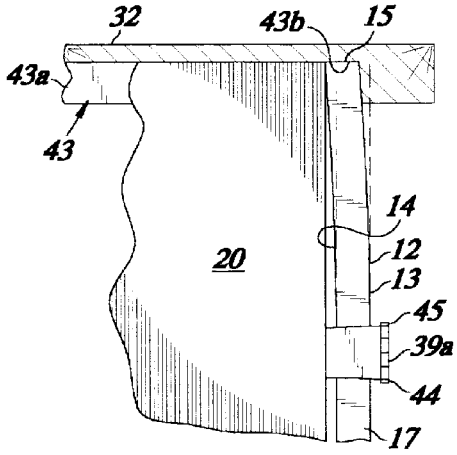
FIG. 4 is a fragmentary sectional side view of the back and right side member of the desk with an upper portion of the back transversely bent and effectively spring loaded to fit and spring lock into a mating groove in a bottom surface of the planar top of the desk to tightly interlock the back and side members the top in accordance with the present invention.

In particular, in accordance with the present invention, at least one of the planar back 12, right side member 20 and left side member 26 is transversely bendable from the plane thereof adjacent its top edge surface to provide an effective spring loaded interlocking of the top edge surface in the mating groove 43 in the bottom surface of the planar top member 32. By way of example, such a spring loaded interlocking for the back member 12 into the slot 43 is depicted in FIGS. 2 and 4.

Specifically, as shown in FIG. 2, to accommodate such an interlocking, the U-shaped slot 43 comprises interconnecting sections 43*a*, 43*b* and 43*c*. The slot section 43*a* extends in the bottom surface 34 from a closed end 43*d* in a direction rearward and parallel to the right edge surface 35 of the planar top member 32. The slot section 43*b* connects with an open end of the slot section 43*a* and extends to the right in a direction parallel to a back edge surface 36 of the top member. The slot section 43*c* connects to the opposite end of the slot 43*b* and extends forward in a direction parallel to the left edge surface 37 to a closed end 47.

Figure 4A:
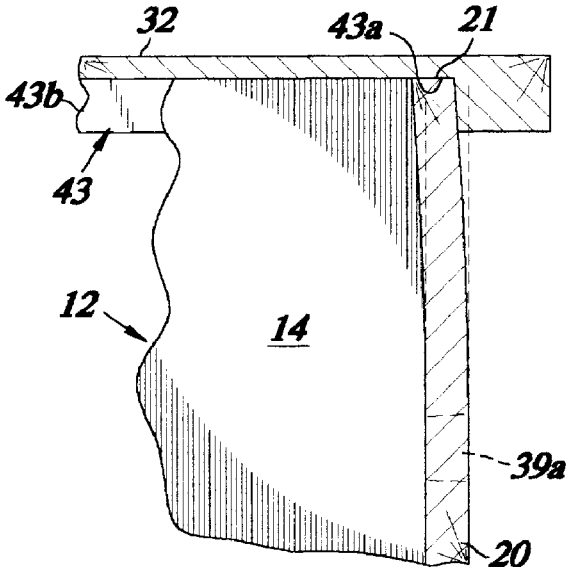
FIGS. 4*a* and 4*b* are fragmentary sectional side views, similar to FIG. 4, and showing the back and right and left side members of the desk.
Figure 4B:
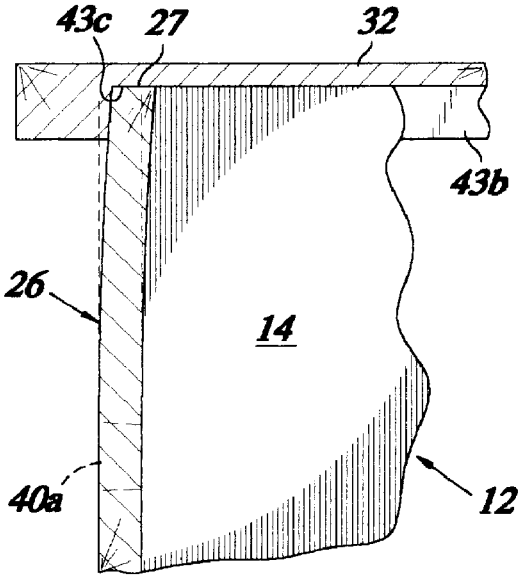

The slot 43 is dimensioned in length, width and depth to receive the top edge surfaces 15, 21 and 27 of the back member 12, right side member 20 and left side member 26 to tightly interlock to the top 32 and to each other when the right and left side members are in an unfolded position depicted in FIGS. 1 and 2. In this regard, as indicated in FIG. 2, when it is desired that the back 12 be the transversely bendable member for spring loaded interlocking in the slot 43, the length "x" of the slot sections 43*a* and 43*c* is or can be slightly less than the distance "d" between edge surface 23 and 30 of the side member 20 and 26 and the back surface 13 of the back member 12 in the unfolded or set up position of FIGS. 1 and 2. Under such conditions, in order for the top edge surface of the back member 12 to fit into the slot section 43*b*, the upper portion of the back member 12 must be bent slightly forward so that the distance "d" becomes equal to or slightly less than the length "x" of the slot sections 43*a* and 43*c*. Such bending action for the back member 12 is depicted in FIG. 4 and creates a spring loaded interlocking of the back and side members 12, 20 and 26 with the top members 32 to create a sturdy construction for the desk. A similar slot length and side to side width relationship may exist for the slot section 43*b* and the distance between the outermost surfaces of the side members 20 and 26 when it is desired that either the side member 20 or the side member 26 comprise the transversely bendable member for spring loaded interlocking in the slot 43 as depicted in FIGS. 4*a* and 4*b*, respectively.

Figure 9:
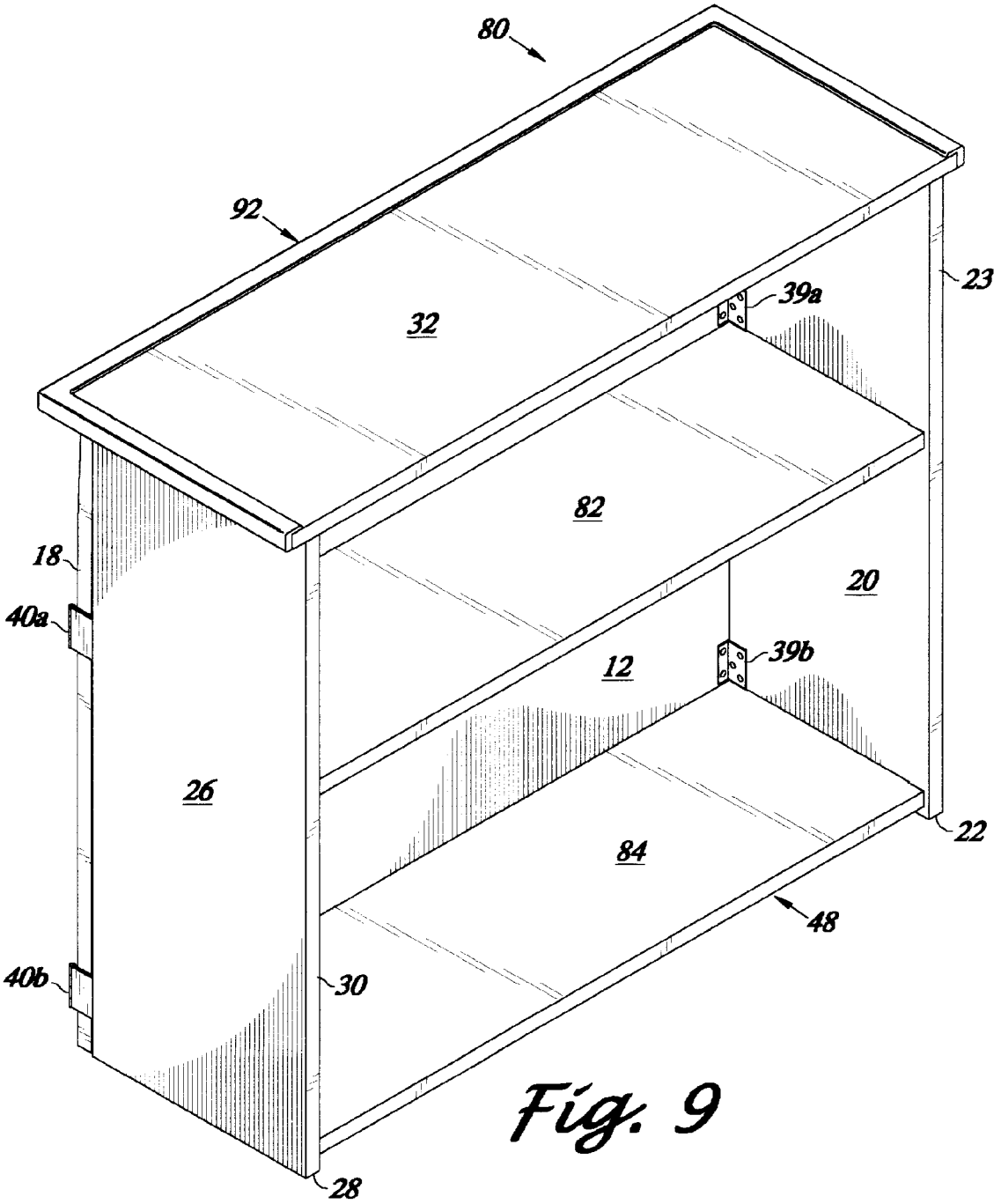
FIG. 9 is a perspective view of a hand foldable and portable bar according to the present invention.
Figure 10:
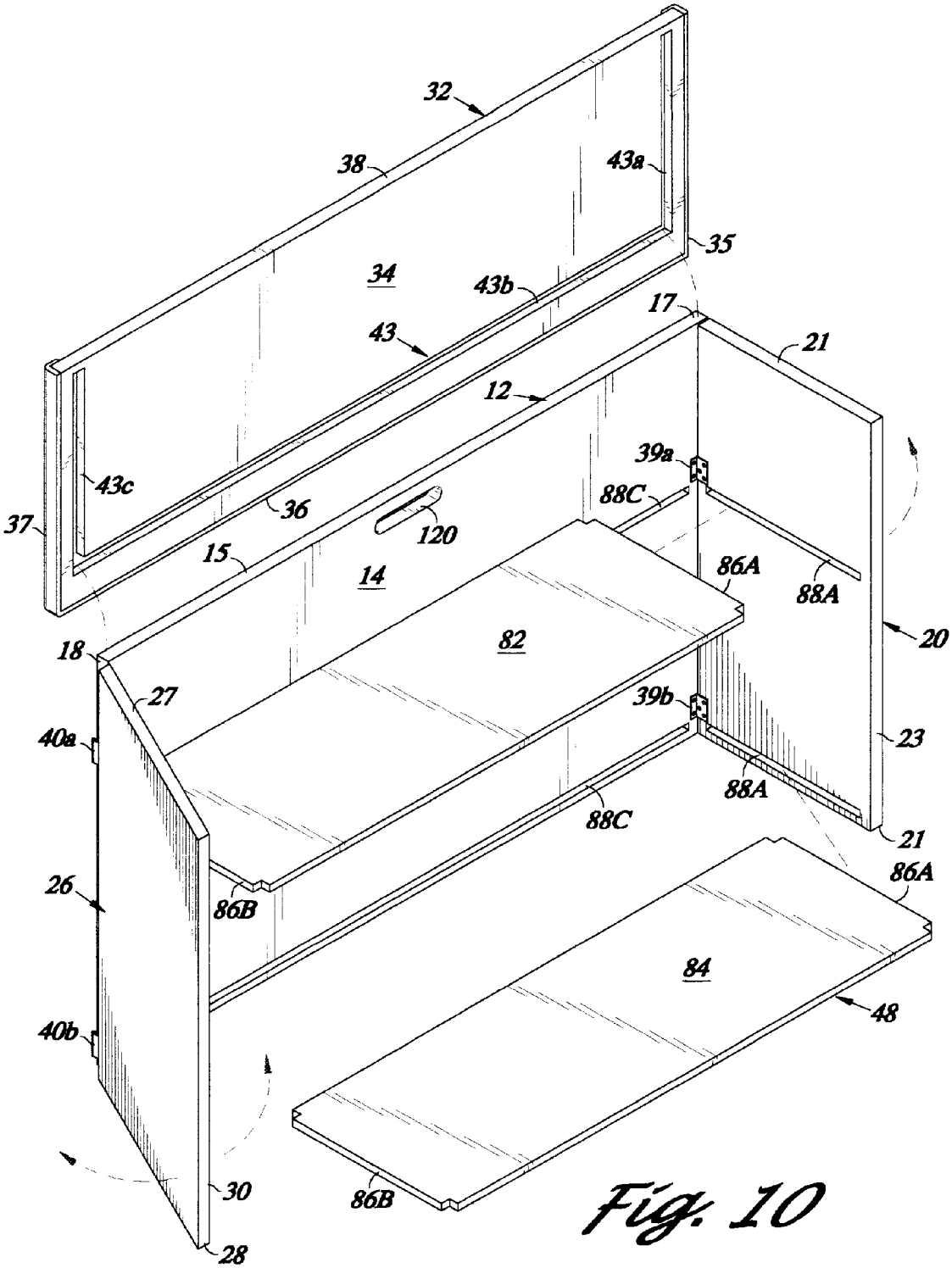
FIG. 10 is an exploded view of the bar of FIG. 9 illustrating the component parts thereof.
Figure 11:
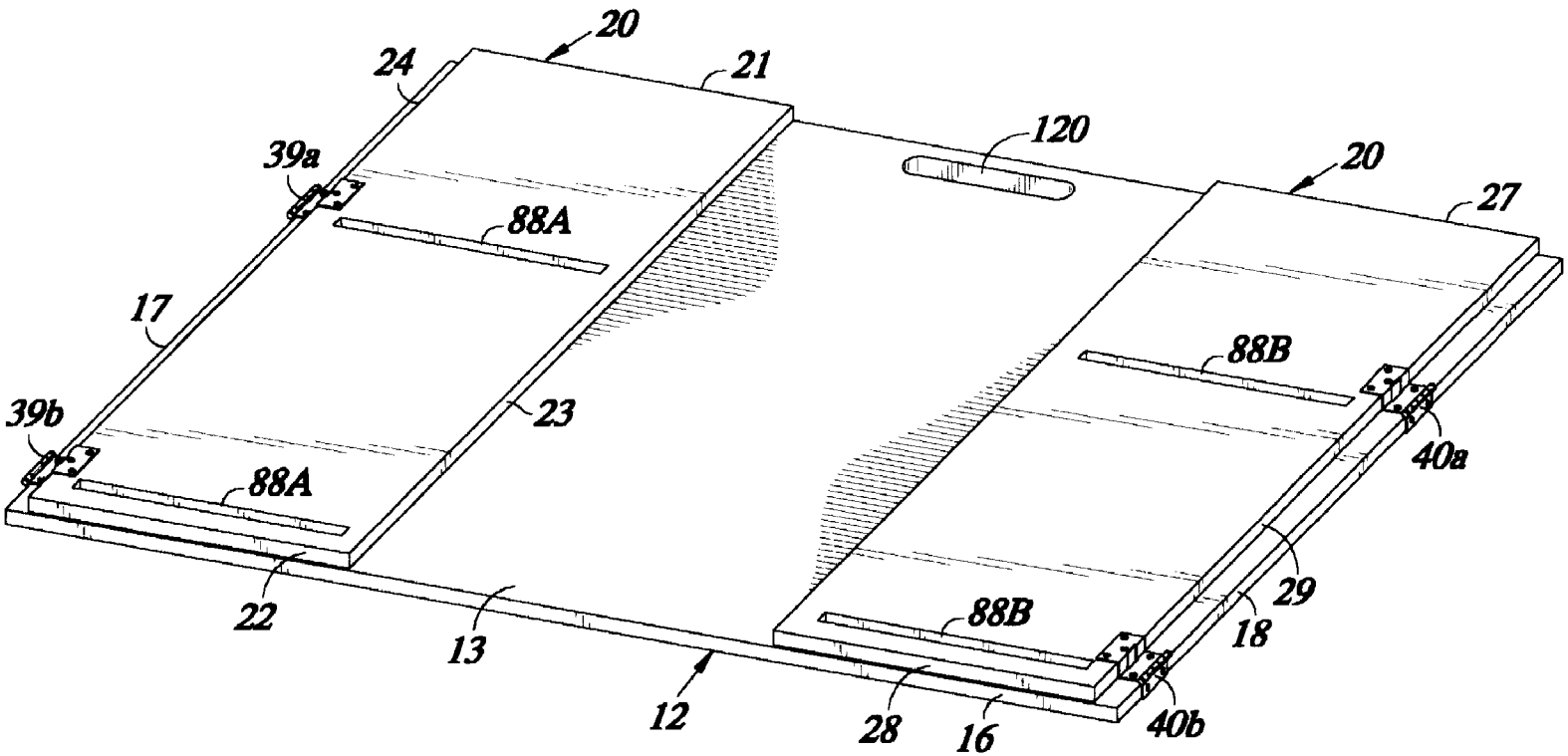
FIG. 11 is a perspective view of the back and side members of the bar of FIG. 10 in their folded position with the right and left side members folded over and substantially parallel to a back surface of the back member of the bar.
Figure 15:
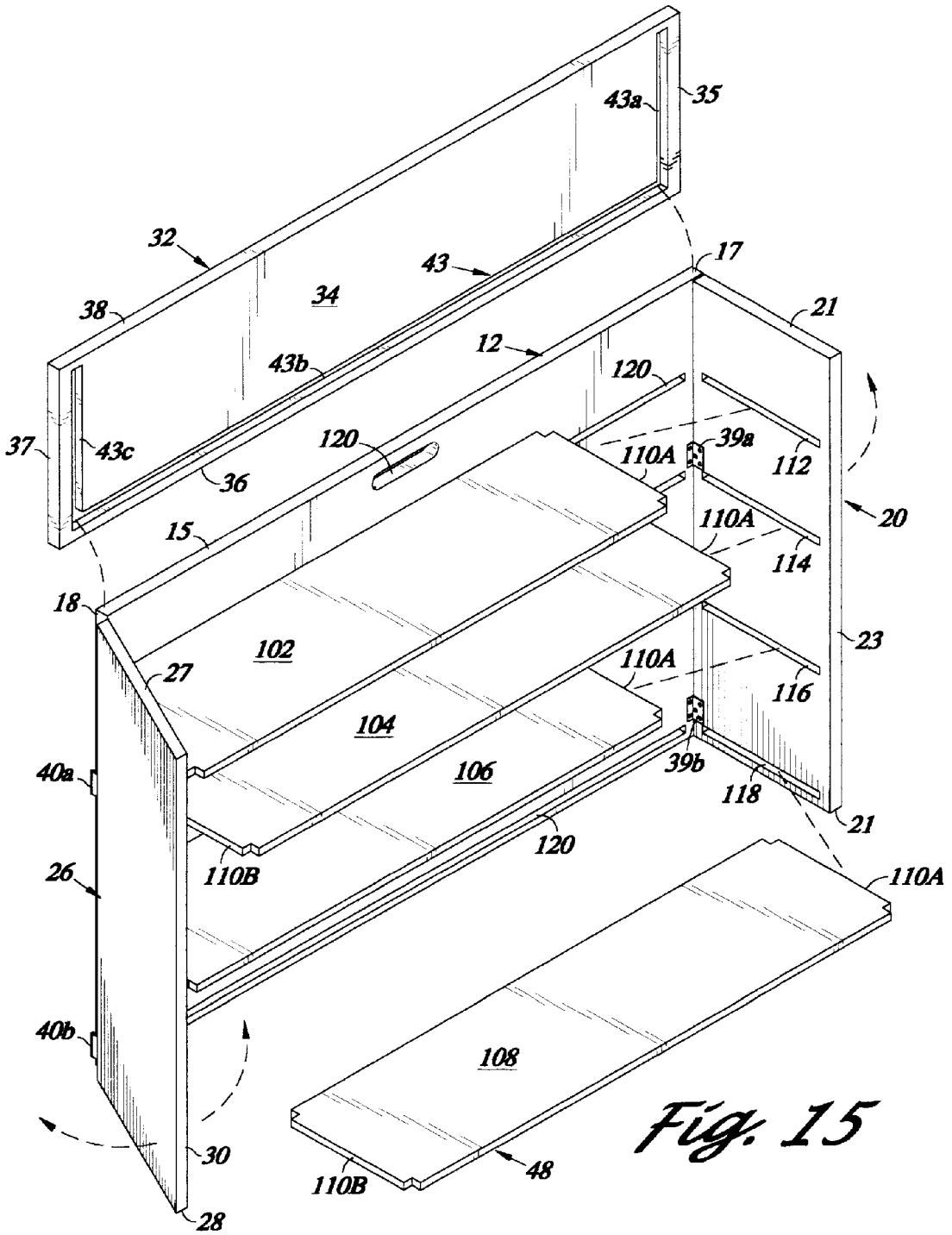
FIG. 15 is an exploded view of the bookcase of FIG. 14 showing the component parts thereof.
Figure 16:
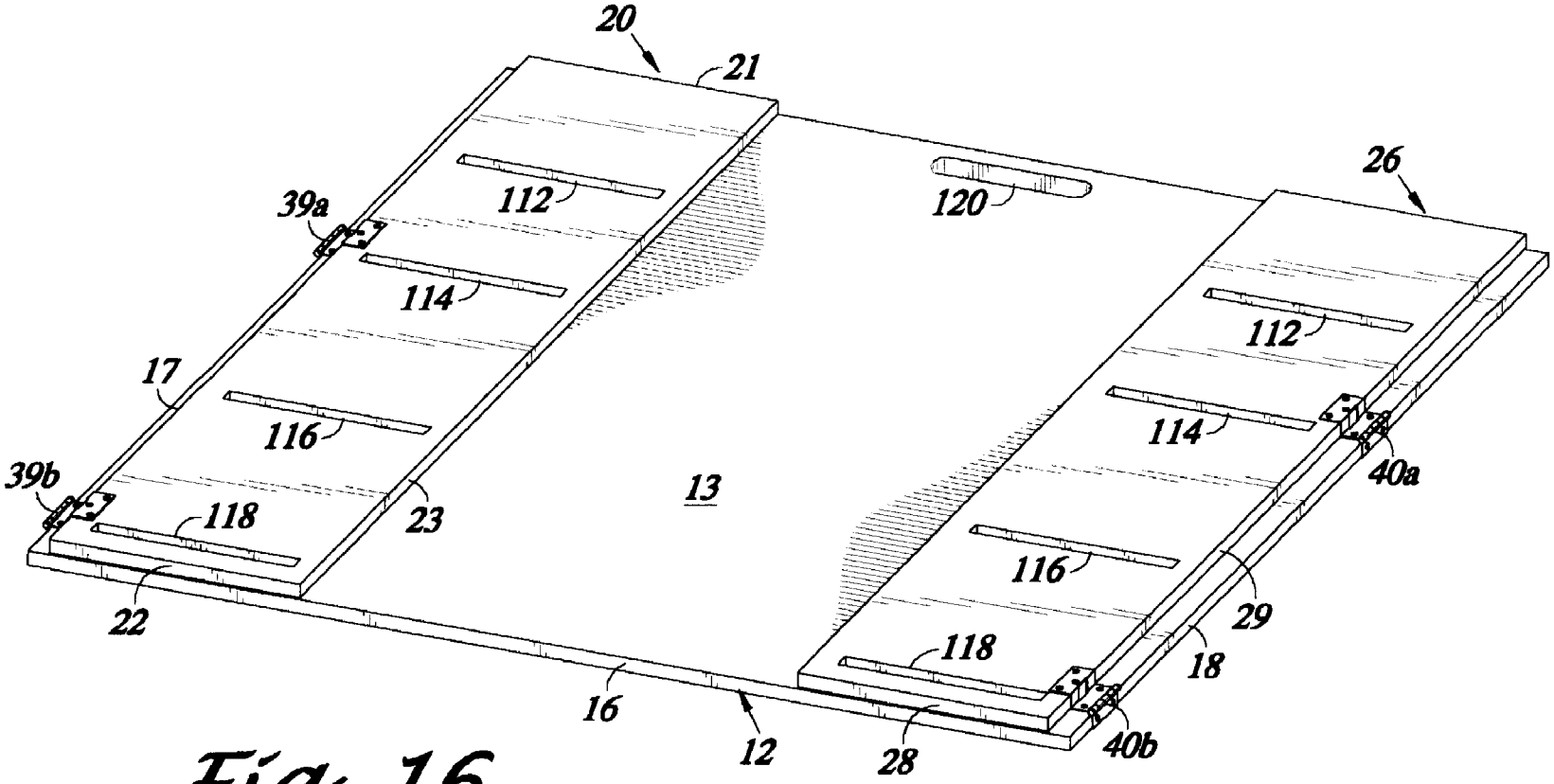
FIG. 16 is a perspective view of the back and right side members of the bookcase of FIG. 15 in the folded position with the right and left side members folded back over the back of the back member and lying substantially parallel thereto.

Also, common to each of the embodiments of the present invention is the foldability of the back and right and left side members where by virtue of the unique hinge connections 39 and 40, the right and left side members 20 and 26 are foldable over the back surface 13 of the back member 12 to lie substantially parallel to a back thereof as depicted for the desk 10 in FIG. 3, for the bar 80 and counter 90 in FIG. 11 and for the bookcase 100 in FIG. 16. From such a compact folded position, and by virtue of the unique hinge connections according to the present invention, the right and left side members 20 and 26 are moveable to the unfolded or set up positions substantially perpendicular to the back member 12 as depicted in FIGS. 1 and 2 for the desk 10, in FIGS. 9 and 10 for the bar 80, in FIGS. 12 and 13 for the counter 90 and in FIGS. 14 and 15 for the bookcase 100.

Further, although not illustrated in the drawings, each of the articles of furniture of the present invention is suitable for semipermanent set up as, for example, by the addition of screws in the top extending into the upper edges of the back and side members.

From a viewing of the above referenced drawings for the different embodiments for the present invention, it should be readily appreciated that each of the embodiments have in common the back, right and left side and top members 12, 20,26 and 32 as described in detail for the desk of FIG. 1. Further, in each embodiment, the right and left side members 20 and 26 are connected by first and second hinge means 39 and 40. Accordingly, for each of the different embodiments of the present invention, common reference numerals are applied to common elements and the detailed description of the structure and interconnection thereof related to the desk 10 will not be repeated for each of the various embodiments.

Figure 5:
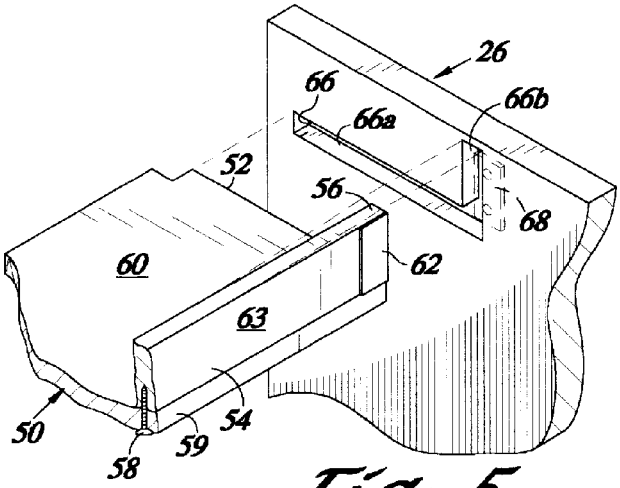
FIG. 5 is a fragmentary exploded view showing the shelf of FIG. 2 and an L-shaped groove in the left side member of the desk for receiving the end surfaces of the shelf and a vertically extending back when the back is transversely bent and effectively spring loaded to fit and spring lock into the vertically extending portion of the L-shaped groove.
Figure 6:
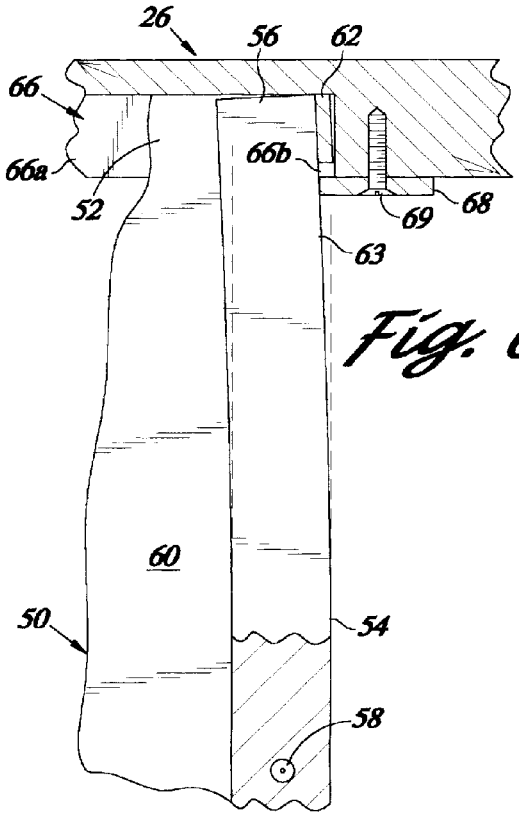
FIG. 6 is a fragmentary sectional top view of the shelf and left side member illustrated in FIG. 5 showing the transversely bendable portion of the vertically extending back of the shelf bent forward to fit into the mating groove in the left side member with a wedge extending from a back of the vertically extending back of the shelf and being captured in the groove by a lock plate secured to an inside surface of the left side member of the desk.

Also, each of the embodiments of the article of furniture of the present invention includes a shelf construction. The shelf construction for the desk 10 of FIG. 1 is different than the shelf constructions for the bar 80, counter 90, and bookcase 100. In particular, and as depicted at 48 in FIGS. 2, 5 and 6, the shelf assembly for the desk 10 comprises a planar shelf 50 having opposing end surfaces 51 and 52. An upwardly extending back 54 having opposing end surfaces 55 and 56 is secured as by screws 58 to a back edge 59 of a top surface 60 of the shelf 50. As shown in FIGS. 5 and 6, the left-most screw 58 is spaced a distance of about fifteen inches from the left end surface of the shelf 50 to define a transversely bendable end for the upwardly extending back 54. A small flat wedge member 62 is secured to a rear surface 63 of the back 54 at the left end of the shelf 50. The opposing end surfaces 51 and 52 of the shelf 50 and the opposing end surfaces of the back 54 are designed to fit into carefully dimensioned L-shaped closed-end grooves 64 and 66 in inside surfaces of the right and left side members 20 and 26, respectively. In this regard, the L-shaped grooves 64 and 66 include horizontal sections 64*a* and 66*a* and connecting vertical sections 64*b* and 66*b* respectively. As depicted in FIG. 2, the length "l" of the horizontal sections 64*a* and 66*a* is equal to or only slightly greater than the depth "d1" of the shelf 50 with the back 54 secured on a top thereof. Therefore, in order for the left end surfaces of the shelf 50 and back 54 carrying the wedge 62 to fit into the groove sections 66*a* and 66*b*, the transversely bendable left end portion 56 of the back 54 must be bent forward from the plane of the back as depicted in dashed outline in FIG. 5 and in solid outline in FIG. 6 as the left end 52 of the shelf 50 is inserted into the horizontal section 66*a* of the groove 66 and the left end of back 54 and wedge 62 are inserted into the vertical section 66*b* of the groove 66. To insure the capture of the back 54 and wedge 62 in the vertical section 66*b* of the groove 66, a lock plate 68 may be secured as by a screw 69 to the inner surface of the left side member 26 to extend over an edge of the vertical section 66*b* of the groove 66 as shown in FIG. 6. The bending of the left end portion 56 of the back 54 secured to the shelf 50 by the screws 58 develops a spring return force in the portion 56 causing the wedge 62 to tightly bear on a side of the groove section 66*b* to enhance the interlocking of the shelf assembly in the desk 10 between the left and right side members 20 and 26. This supplements the spring loaded interlocking of the left and right side, back and top members as depicted in FIG. 4 to render the desk assembly of FIG. 1 sturdy and highly stable.

The shelf 50, thus firmly secured between the right and left side members 20 and 26 of the desk 10, provides firm support for a shelf drawer 70. The shelf 70 is slidably supported by conventional track guide mechanisms 71 and 72 on a top of the shelf 50 to slide in and out of the desk 10 as when it is desired to use a computer keyboard supported by the shelf 70 with a keyboard connecting cable passing through a cable hole 74 in the back 54 of the shelf assembly 48.

As previously indicated, the shelf construction included in each of the other embodiments of the present invention including the bar 80, the counter 90 and the bookcase 100, if desired, may include the upwardly extending spring loaded back for the shelves thereof the further enhance the spring loaded interconnection and interlocking of the back and right and left side members thereof. In the illustrated versions of the bar, counter and bookcase, however, such a supplemental spring loaded interconnection is not included.

In that regard, and is depicted most clearly in FIG. 10, the bar 80 includes two planar shelf members 82 and 84 each having outwardly extending opposing tongues 86A and 86B. The right and left side members 20 and 26 and the back 12 include vertically spaced horizontally extending closed end grooves 88A, 88B and 88C dimensioned to receive the outwardly extending tongue 86A and 86B and a back edge surface of the shelves 82 and 84 respectively during assembly of the bar 80 as when the right and left side members are being moved to the unfolded position depicted in FIG. 9.

As with the illustrated embodiment of the desk 10, during the assembly of the bar 80, the upper portion of one of the back and side members is bendable to interlock in the groove 43 in the top 32. For example, the back 12 may be bent forward slightly to fit into the mating portion of the "U" shaped slot 43 in the bottom surface 34 of the planar top member 32. In this manner, the tongue and groove interconnection of opposing ends of the shelves 82 and 84 in the grooves 88A and 88B and the mating of the rear edge of the shelves in the grooves 88C further enhances the rigidity of the bar 80 in its assembled condition as illustrated in FIG. 9.

As with the desk 10, when the bar 80 is to be disassembled, the top member 32 is simply lifted upward as depicted in FIG. 10 and the shelves 82 and 84 removed from the sides and back as the sides are swung on the hinge means 39 and 40 to assume the folded position depicted in FIG. 11.

Figure 12:
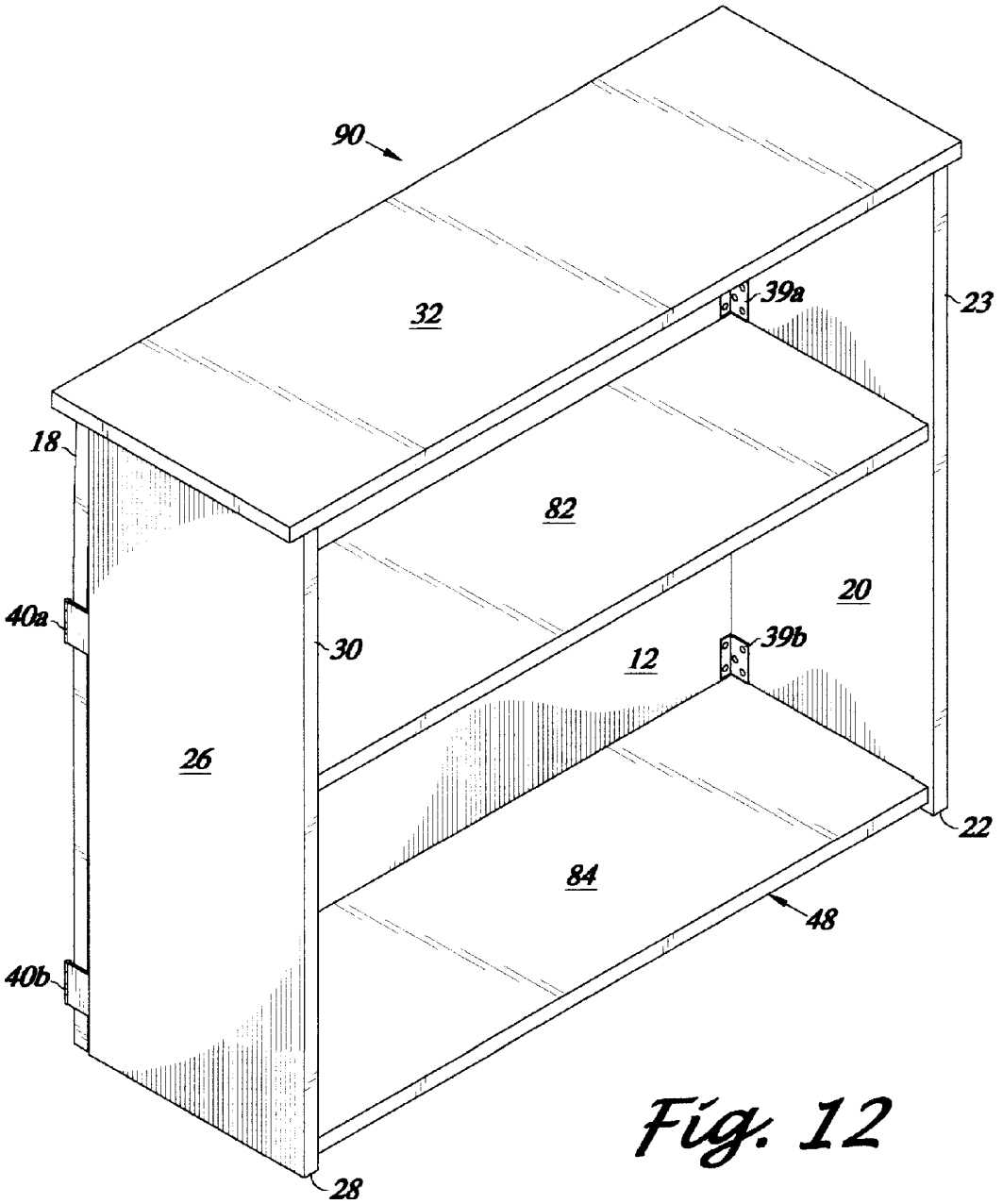
FIG. 12 is a perspective view of a counter according to the present invention.
Figure 13:
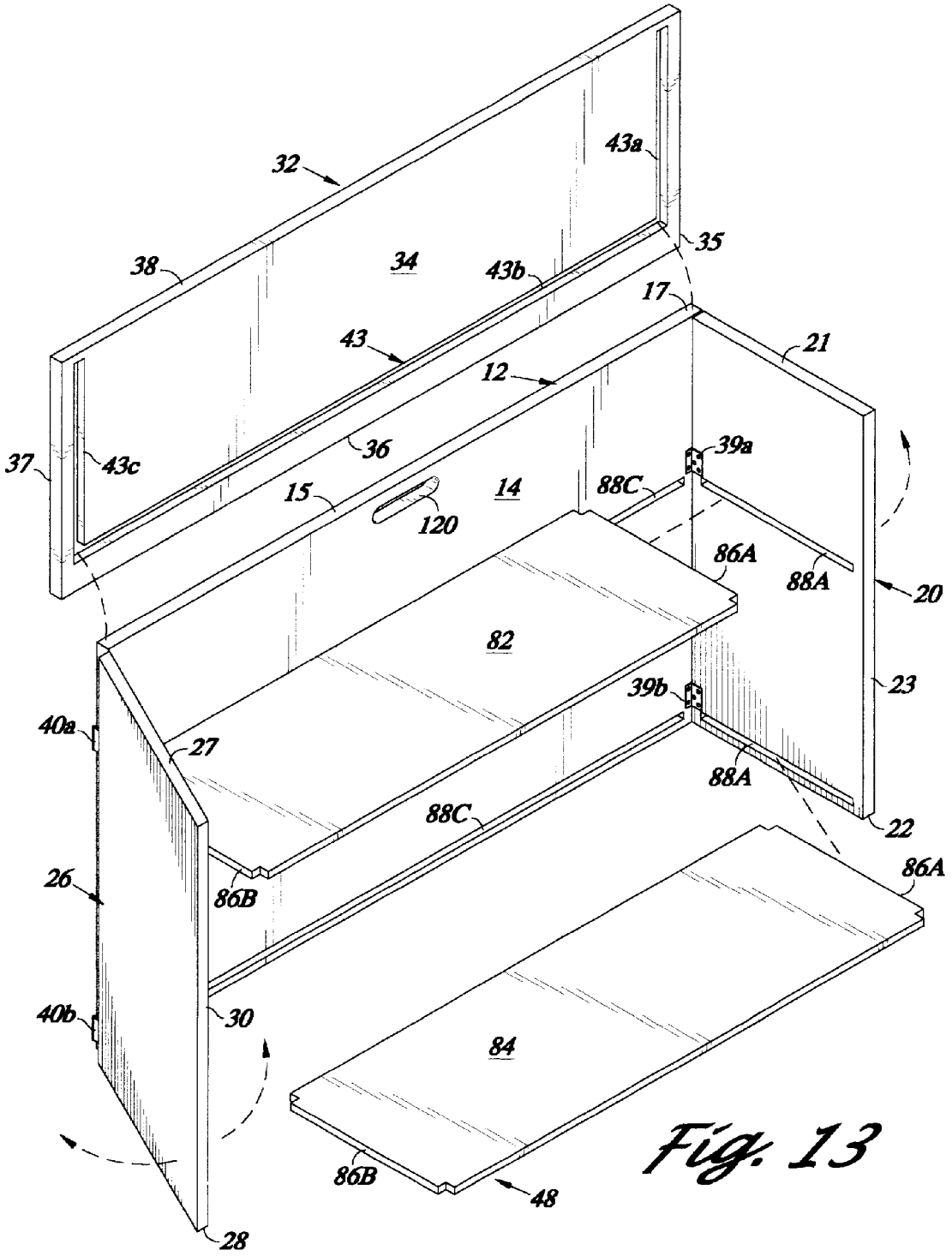
FIG. 13 is an exploded view of the counter of FIG. 12 showing the component parts thereof.

By comparing the bar 80 of FIGS. 9 and 10 with the counter 90 of FIGS. 12 and 13, is to be appreciated that the structures and assembly and disassembly of the bar and counter are identical and that the only structural difference is the raised ridge on the marginal right and left edge surfaces and back of the top 32 of the bar 80 denoted by the number 92.

Figure 14:
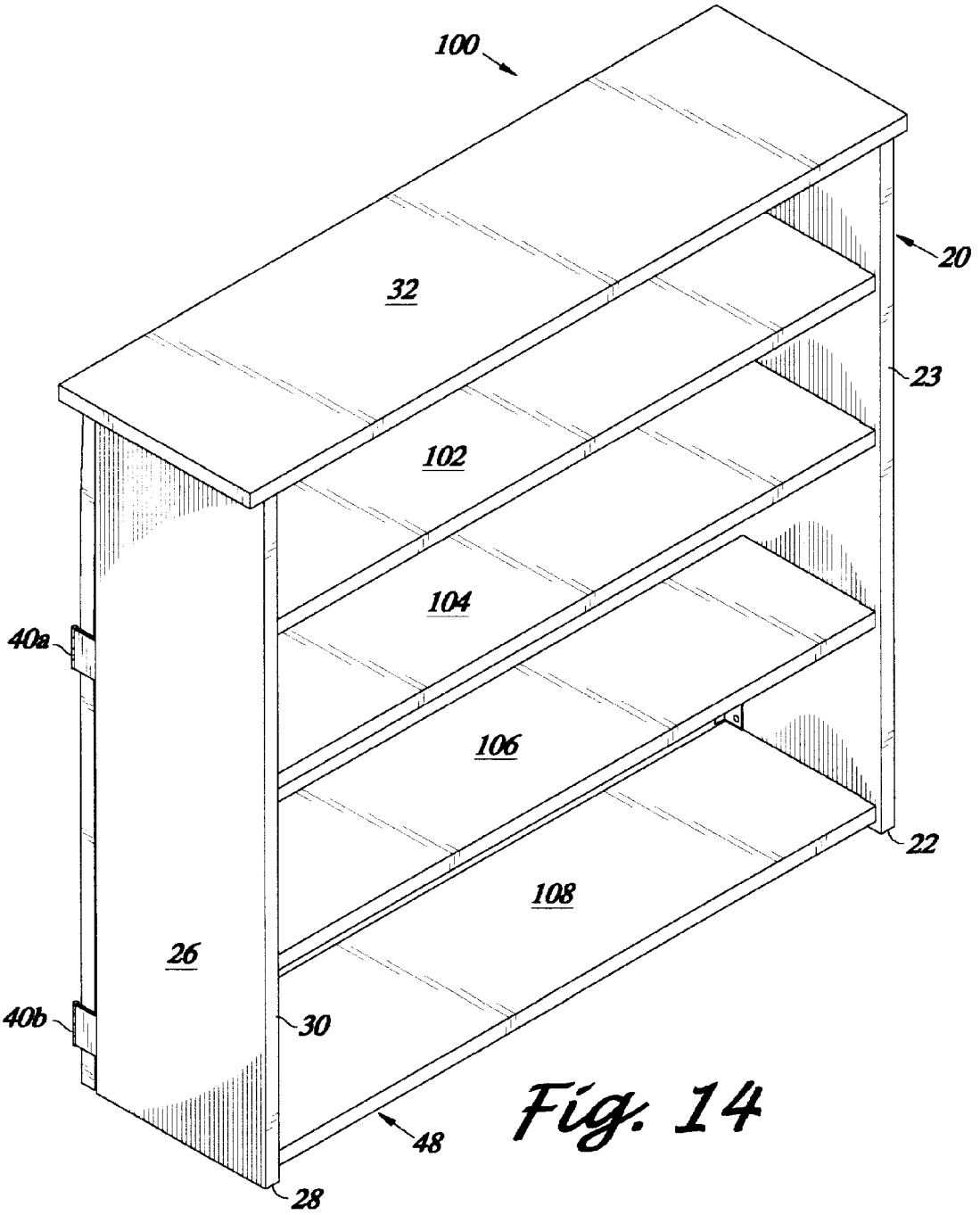
FIG. 14 is a perspective view of a bookcase according to the present invention.

The bookcase 100 as illustrated in FIGS. 14, 15 and 16 differs from the counter 90 in that the bookcase includes a different number of planar shelf members and mating grooves. By way of example, the illustrated bookcase 100 includes planar shelves 102, 104, 106 and 108. Each have outwardly extending opposing tongues 110A and 110B designed to fit tightly into mating pairs of closed end grooves 112, 114, 116 and 118 in the right and left side members 20 and 26 of the bookcase 100 while to rear edges of the shelves fit into closed end horizontal grooves 120 in the forward surface 14 of the back 12.

Again, as with the desk 10, bar 80 and counter 90, the back 12, side members 20 and 26 and planar top member 32 of the bookcase 100 are tightly interlocked by virtue of the spring-loaded connection of the upper portion of one of the back and side members in fitting into the mating section of the slot in the bottom surface of the top member. This, in addition to the interlocking provided by the shelves of the bookcase 100, produces a highly sturdy and stable bookcase when the bookcase is assembled during movement of the side members 20 and 26 to the unfolded of set up position illustrated in FIG. 15 and the subsequent bending of one of the back or side members and insertion of the upper edge thereof into the corresponding section of the slot in the lower surface of the top member 32.

Further, as with the other articles of furniture according to the present invention, when it is desired to disassemble the bookcase, the assembly operation is simply reversed and the right and left side members are moved to the folded position illustrated in FIG. 16 with the side members lying on and substantially parallel to the back surface 13 of the back member 12.

In the folded position illustrated in FIG. 16 for the bookcase 100 and in FIG. 10 for the bar 80 (and counter 90) and in FIG. 3 for the desk 10, the back and side members in the folded position may be simply packaged for easy transport. Such transport is aided by the hand slot 120 illustrated in each of FIGS. 2, 10, 11, 13, 15 and 16.

Thus, the present invention also includes a method of assembling a foldable and portable article of furniture comprising the steps of connecting a planar right side member to a planar back member by a hinge spaced from a top edge surface of the back and right side members to swing the right side member between a folded position substantially parallel to and on a back of the back member to an unfolded or set up position substantially perpendicular to the back member. That step is repeated for a planar left side member connected to the back member by a second hinge spaced from a top edge surface of the back and left side members to swing the left side member between a folded position substantially parallel to and on a back of the back to an unfolded or set up position substantially perpendicular to the back member. That step is followed by a bending of a bendable top edge surface of one of the back and side members and securing the top edge surface of the back and right and left side members in mating grooves in a bottom surface of a planar top member of the article of furniture to interlock the back and right and left side members to the planar top member.

The method of the present invention is enhanced when the article of furniture includes a shelf having a transversely bendable upwardly extending back which when bent from its plane is inserted into a mating groove in one of the right and left side members to aid in interlocking the planar shelf to the right and left side members.

While particular articles of furniture and a method of assembly have been described in detail hereinabove, changes and modifications may be made therein without departing from the spirit of the present invention. Accordingly the present invention is to be limited in scope only by the terms of the following claims.

I claim:

1. A hand-foldable and portable article of furniture comprising;

a planar back member having a back and a front and top, bottom, right and left edge surfaces;

a planar right side member having top, bottom, right and left edge surfaces;

a planar left side member including top, bottom, right and left edge surfaces, at least one of the planar back, right side and left side members being transversely bendable from the plane thereof adjacent its top edge surface;

first hinge means spaced from the top edge surfaces of the back and right side members and located at the right edge surface of the back and at the left edge surface of the right side member for swinging the right side member on an axis substantially parallel to the right edge surface of the back member between a folded position parallel to and on the back of the back member to an unfolded position substantially perpendicular to the back member;

second hinge means spaced from the top edge surfaces of the back and left side members and located at the left edge surface of the back member and at the right edge surface of the left side member for swinging the left side member on an axis substantially parallel to the left edge surface of the back member between a folded position substantially parallel to and on the back of the back member to an unfolded position substantially perpendicular to the back member; and a planar top member including top and bottom surfaces and having a slot in the bottom surface dimensioned to receive the top edge surface of the back, right side and left side members when the at least one of the planar back, right side or left side members is transversely bent adjacent its top edge surface to firmly interlock the top member to the back, right side and left side members when the right and left side members are in the unfolded position.

2. The article of furniture of claim 1 wherein the first hinge means comprises a first plate connected to the back member at the right edge surface thereof and extending from a vertically extending pivot adjacent the back of the back member and a second plate extending from the pivot a distance greater than a width of the back member to connect to the right side member at the left edge surface thereof.

3. The article of furniture of claim 2 wherein the second hinge means comprises a third plate connected to the back member at the left edge surface thereof and extending from a vertically extending pivot adjacent the back of the back member and a fourth plate extending from the pivot a distance greater than the width of the back member to connect to the left side member at the right edge surface thereof.

4. The article of furniture of claim 1 further comprising:

a planar shelf member having opposing outwardly extending tongues and;

wherein the right and left side members include closed-end grooves receiving the opposing outwardly extending tongues to interlock the shelf member to the side members in the unfolded position.

5. The article of furniture of claim 1 further comprising:

a plurality of planar shelf members each having outwardly extending opposing tongues; and wherein the right and left side members each include matching pairs of closed-end grooves for receiving opposing outwardly extending tongues of different ones of the shelves to interlock the shelves to the side members when in the unfolded position.

6. The article of furniture of claim 1 further comprises:

a planar shelf having opposing end surfaces;

an upwardly extending back having opposing end surfaces;

means for securing the upwardly extending back to the planar shelf at a location spaced from one of the opposing end surfaces of the shelf to define a transversely bendable end for the upwardly extending back; and L-shaped closed-end grooves in the right and left side members dimensioned to receive the opposing end surfaces of the planar shelf and the opposing end surfaces of the upwardly extending back when the transversely bendable end is bent to interlock the shelf and the right and left side members in the unfolded position.

7. The article of furniture of claim 6 further including a second shelf slidably supported on a top of the planar shelf to slide in and out of the article of furniture.

8. The article of furniture of claim 6 further including a wedge on a back surface of the upwardly extending back for fitting into its mating groove to more tightly secure the transversely bendable end of the upwardly extending back in the groove.

9. The article of furniture of claim 8 further including a locking plate secured to one of the side members adjacent the groove and extending over the wedge to releaseably lock the wedge and upwardly extending back within the groove.

10. A method of assembling a foldable and portable article of furniture comprising:

(a) connecting a planar right side member to a planar back member by a first hinge spaced from a top edge surface of the back member and from a top edge surface of the right side member to swing the right member between a folded position substantially parallel to and on a back of the back member to an unfolded position substantially perpendicular to the back member:

(b) connecting a planar left side member to the planar back member by a second hinge spaced from the top edge surface of the back member and from a top edge surface of the left side member to swing the left side member between a folded position substantially parallel to and on the back of the back member to an unfolded position substantially perpendicular to the back member; and (d) with the back and right and left side members in the unfolded position, bending one of the top edge surfaces of one of the back and side members and securing it in a mating groove in a bottom surface of a planar top member of the article of furniture to interlock the back and right and left side members to the planar top member.

11. The method of claim 10 further including prior to step (d), the step of inserting opposing ends of a planar shelf into mating closed-end grooves in the right and left side members to interlock the shelf to the right and left side members in the unfolded position.

12. The method of claim 11 further including a step of bending a transversely bendable portion of an upwardly extending back secured to the planar shelf at a location spaced from one of its opposing end surfaces and inserting an end of the bent portion into one of the mating grooves in one of the right and left side members to aid in interlocking the planar shelf to the right and left side members.

13. A hand foldable and portable article of furniture comprising planar back and right and left side members hinged at edge surfaces thereof such that the right and left side members swing between a folded position with the side members on a back of the back member and an unfolded position in which the side members are substantially perpendicular to the back member and upper edges of the back and side members are interlocked in mating grooves in a planar top member, one of the back and side members being transversely bendable at its upper edge to spring lock into its mating groove to tightly interlock the article of furniture in its unfolded position.

* * * * *